US009663321B2

(12) United States Patent
Barea

(10) Patent No.: US 9,663,321 B2
(45) Date of Patent: May 30, 2017

(54) METHOD AND DEVICE FOR FEEDING A METAL WIRE TO AN OPERATING MACHINE AT A CONSTANT TENSION AND QUANTITY

(71) Applicant: BTSR INTERNATIONAL S.P.A., Olgiate Olona (Varese) (IT)

(72) Inventor: Tiziano Barea, Busto Arsizio (IT)

(73) Assignee: BTSR INTERNATIONAL S.P.A., Olgiate Olona (Varese) (IT)

( * ) Notice: Subject to any disclaimer, the term of this patent is extended or adjusted under 35 U.S.C. 154(b) by 196 days.

(21) Appl. No.: 14/650,443

(22) PCT Filed: Nov. 29, 2013

(86) PCT No.: PCT/IB2013/060494
§ 371 (c)(1),
(2) Date: Jun. 8, 2015

(87) PCT Pub. No.: WO2014/097027
PCT Pub. Date: Jun. 26, 2014

(65) Prior Publication Data

US 2015/0314982 A1 Nov. 5, 2015

(30) Foreign Application Priority Data

Dec. 20, 2012 (IT) ..... MI2012A2185

(51) Int. Cl.
*B65H 59/38* (2006.01)
*B65H 59/18* (2006.01)
(Continued)

(52) U.S. Cl.
CPC ..... *B65H 59/388* (2013.01); *B65H 59/18* (2013.01); *H01F 41/064* (2016.01); *H01F 41/094* (2016.01); *B65H 2701/36* (2013.01)

(58) Field of Classification Search
CPC .. B65H 59/18; B65H 59/388; B65H 2701/36; H01F 41/064; H01F 41/094
See application file for complete search history.

(56) References Cited

U.S. PATENT DOCUMENTS

2009/0178757 A1 7/2009 Cocovi et al.
2011/0049286 A1 3/2011 Harada et al.
2011/0114781 A1 5/2011 Kimura et al.

FOREIGN PATENT DOCUMENTS

CN 1482630 A 3/2004
CN 1487540 A 4/2004
(Continued)

OTHER PUBLICATIONS

Office Action of Nov. 1, 2016 from Chinese Patent Application No. 2013867352.2 to BTSR International S.P.A.
(Continued)

*Primary Examiner* — William E Dondero
(74) *Attorney, Agent, or Firm* — Vorys, Sater, Seymour and Pease LLP

(57) ABSTRACT

A system for feeding a metal wire to a machine by a wire feeder, the wire being fed at a constant and desired tension detected by a tension sensor, the feeder having at least one rotary member driven by an actuator thereof onto which the metal wire is wound for a rotation or fraction of rotation and suitable to feed the wire to the machine at the pre-set tension under the action of a control unit. A detector to detect the quantity of wire fed is provided and connected to the control unit to provide the control unit with the quantity data thereof, the control unit intervening on the rotary member to keep the quantity of wire fed at least within a reference value.

16 Claims, 2 Drawing Sheets

(51) Int. Cl.
*H01F 41/094* (2016.01)
*H01F 41/064* (2016.01)

(56) References Cited

FOREIGN PATENT DOCUMENTS

| | | | |
|---|---|---|---|
| CN | 101218088 | A | 7/2008 |
| EP | 0926090 | A2 | 6/1999 |
| EP | 2306473 | A1 | 4/2011 |
| TW | 200922857 | A | 6/2009 |
| TW | 200940768 | A | 10/2009 |

OTHER PUBLICATIONS

International Search Report and Written Opinion mailed Mar. 19, 2014 for PCT/IB2013/060494 to BTSR International S.P.A. filed Nov. 29, 2013.
Office Action and Search Report of Jan. 11, 2017 from Taiwanese Patent Application No. 102146502 to BTSR International S.P.A.

METHOD AND DEVICE FOR FEEDING A METAL WIRE TO AN OPERATING MACHINE AT A CONSTANT TENSION AND QUANTITY

CROSS-REFERENCE TO RELATED APPLICATIONS

This is a §371 National Stage application of International Application No. PCT/IB2013/060494 filed on Nov. 29, 2013, claiming the priority of Italian Patent Application No. MI2012A002185 filed on Dec. 20, 2012.

The present invention relates to a method and device for feeding a metal wire to a machine according to the preamble of the corresponding independent claims. The introductory parts of these claims can be read in EP 0 926 090.

Numerous industrial processes (manufacturing of electric motors, coils, etc.) are known which require the winding of a metal wire onto a physical member which may be of different shapes, be made of different materials and be part of the finished product or only be used during the production step.

Wire feeder devices are used in these processes which enable the feeding of a metal wire to a machine at a constant tension. Such devices or feeders comprise one or more wheels or pulleys which one or more coils of wire are wound onto after being picked up from a support coil from which they are unwound. The wire is preferably wound with several coils so as to prevent it from slipping during the feed step.

Such pulleys are placed in rotation by electric motors thereof controlled by an electronic command and control unit which sets the speed of rotation depending on the tension of the wire detected by a loading cell (or other tension sensor), so as to maintain the tension value within a fixed set range or depending on the state of advancement of the work to which said wire is subjected.

The wire being fed onto the pulley which it is wound onto without any slipping, the electronic control unit is able not only to maintain a constant tension during the various operating steps of the machine but also to measure with absolute precision the quantity of wire fed (LWA); this by means, for example, of Hall sensors fitted inside or outside the motor, an encoder applied to the motor or other sensor suitable to detect the number of rotations performed by said motor.

Control of the tension is therefore fundamental in the aforesaid processes to guarantee the constancy and quality of the finished product.

The tension applied to the wire may in addition cause a stretching of the wire and thus a reduction of the cross-section thereof. This fact, as well as varying the mechanical characteristics (dimensions) of the wire, also entails a change in the total resistance of the product itself, the resistance R of a wire being in fact directly proportional to its length and inversely proportional to its cross-section, as specified in the second Ohm's law.

In some winding processes, for example for the production of electric coils, it is fundamental not only to feed the wire at a constant tension, but also to ensure the presence of the same quantity of wire for each finished product (coil), an essential requirement for the finished product to have the desired impedance (resistance) value.

In particular, in the production of electric coils guaranteeing the same quantity (LWA) of wire fed for each piece during its production means standardising production and increasing the quality and the repeatability of the finished product. Measuring and controlling the quantity (LWA) of wire fed means in addition being able to produce coils, which are exactly the same, on a multi-position machine.

Normally on these machines the tension of the wire (unwound from a coil by a feeder) is set (according to a tabular relation) depending on the diameter of the wire. This is a good starting value, but does not take into account the frictions downstream of the feeder, which in fact cause a variation of the real tension with which the wire is effectively wound onto the member and consequently cause a modification of the electric characteristics of the finished product. Obviously, such differences of friction may vary during the course of production (for example as a result of the accumulation of dirt) or from one position to another, making homogeneous, repeatable production practically impossible.

Various types of feeder devices (or simply feeders) specific for metal wires are known and which permit said control, said devices comprising completely mechanical feeders and electromechanical feeders which however have various drawbacks.

The mechanical tension adjustment devices for example must be manually adjusted and controlled position by position and during the entire process. These define an "open loop feed control system" which is unable to correct any errors arising during the process (variation of the input tension of the metal wire coming from the coil, damage or decalibration of one of the springs, accumulation of dirt inside the input wire brake, etc. . . . ).

In addition, in a feeder of the aforementioned type, setting of a single working tension is provided for, so that different tensions for the wrapping step, working step and loading step cannot be set.

Lastly, an entirely mechanical feeder does not permit, as a single device, the entire range of tensions with which metal wires in general are fed to a machine. A number of feeder devices are thus needed or some of them must be mechanically modified so as to be able to work on any type of wire.

Electromechanical devices or feeders, unlike purely mechanical ones, have an electric motor to which a rotary pulley is constrained and onto which the wire coming from the coil winds for at least one rotation after passing through a felt wire brake and before encountering a mobile mechanical arm subject to counter springs. An electronic control unit, as well as controlling operating of the motor, is able to measure the position of said arm and, depending on such position, increase or decrease the speed of the motor and consequently the feed speed of the wire (in practice using said arm as a control for accelerating and braking).

These feeders also have the drawbacks of the mainly mechanical devices mentioned above in that they provide for the use of the mobile arm to tension the wire and operate as an "open loop" without actual control of the final product.

Lastly, electronic braking devices are known of which as well as the recovery mobile arm also provide for a loading cell (or other equivalent tension detector) placed on the output of the feeder, a control unit of the device using the tension value detected to adjust a pre-braking generally upstream of the compensator arm. One such solution is described for example in EP 0424770.

However, even though such solution resolves some problems of the aforementioned devices, it has various drawbacks: for example, despite operating on a closed loop, the aforementioned device is in any case unable to feed the wire at a lower tension than that of unwinding from the coil in that such member can only block the wire and thus increase such tension.

The Italian patent application MI12011A001983, discloses a device which is able to feed a metal wire measuring the tension thereof and making it conform (decreasing or increasing it) to a pre-set, possibly programmable value, by means of a closed loop feed control. In this way, the device is not only able to brake the wire, but also to feed it at a lower tension (and not only higher) to the unwinding tension from a corresponding source coil.

Such known device makes it possible to set the same feed tension of the wire for the entire process to which it is subjected or differentiated so as to have different tensions in different operating steps of the machine wrapping, working, loading); this in an entirely automatic manner or by means of an interface with the machine.

Such device or feeder, despite functioning optimally, controls and adjusts the tension of a general metal wire fed before the wire leaves said device. However, it may happen that the tension of the metal wire varies after having left the feeder during its travel to the machine, in particular for example due to several mechanical passages generally known as wire guides which have the purpose, as said, to guide said wire from the feeder to the point in which the machine actually processes it. There is thus a difference between the tension of the wire coming out from the feeder and the tension of said wire near the point of processing due to the frictions present during the travel. Said difference may thus cause physical variations in the fed wire (cross-section and length) and consequently vary the resistance value of the final product.

In such conditions, the known feeder device mentioned above cannot autonomously intervene to prevent the aforementioned drawbacks; the device is thus unable to automatically compensate what happens downstream of it precisely because it is outside its control loop. In addition, the possible physical modification of the wire is a condition which does not occur regularly and is therefore not predictable (but variable over time): consider for example the friction caused by a mechanical passage (wire guide) which may vary its incidence depending for example on the quantity of lubricant present on the wire or deposited on it as it slides.

In the same way a variation in the unwinding tension of the wire upstream of the feeder may cause a variation of the physical characteristics of the wire (cross-section, length, resistance), thus causing a variation in the resistive value of the final product; this despite feeding said wire at a constant tension, the aforementioned phenomenon being outside the tension control loop operated by the feeder.

The same drawback may be caused by production tolerances of the wire itself used in the production process.

US2009/178757 describes a method of regulating the tension of a reinforcement cable of a tyre. Such method describes a system for winding a wire which is wound from a coil onto a machine by means of a feeder. The machine, which is a winder, receives the cable which is fed at a predefined and desired tension controlled by a tension sensor connected to a control unit.

The feeder comprises rotary members driven by an actuator thereof which the cable winds onto into one or more coils before reaching the machine. During feeding, the feed speed of the wire downstream of the rotary members is controlled, the speed data being used by the control unit to command the actuators of such elements so as to control the tension of the wire.

This solution neither describes nor suggests the control of the quantity of wire or metal cable fed to the machine nor to maintain at a constant value such quantity during feeding.

The aim of the present invention is that of providing a method and a system which permits optimal control of the tension and of the quantity of wire supplied to the machine which processes it, regardless of the characteristic of the fed metal wires, also in the case of a capillary wire.

In particular, one object of the invention is to offer a system of the type mentioned which makes it possible to maintain the quantity of the wire fed to the machine which processes it constant so as to compensate any mechanical tolerances of the member (usually plastic spool) which the wire is wound onto.

A further object of the invention is that of making a system of the aforementioned type which is able to compensate the presence of mechanical frictions exerted by members which the wire passes over on its way to the machine, frictions which may vary from one member to another and from one position to another of the latter along the route of the wire.

These and other objects which will be clear to a person skilled in the art are achieved by a system and a method for feeding a metal wire to a machine according to the attached claims.

For a better understanding of the present invention, the following drawings are appended, merely by way of a non-limiting example, wherein.

Figure 2:
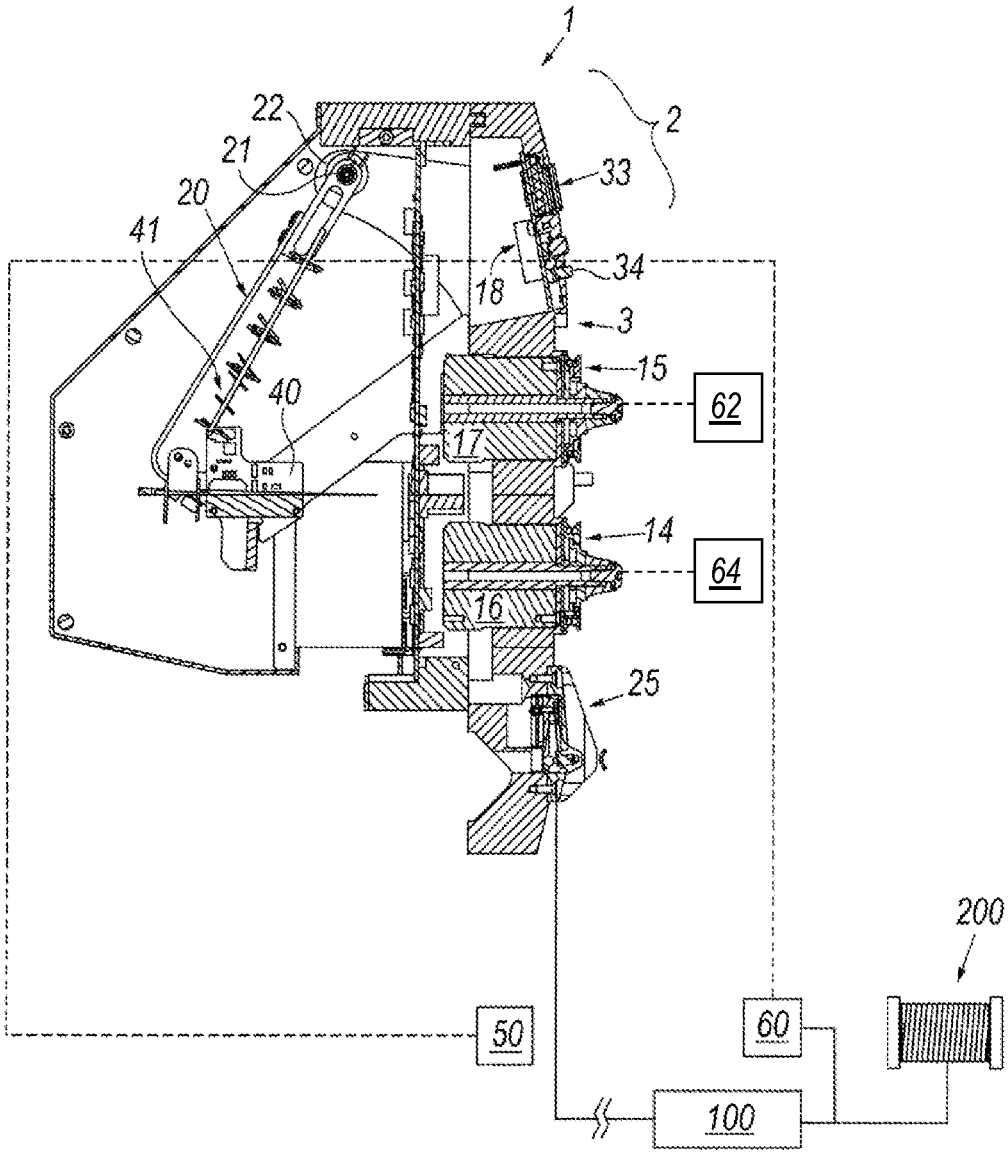
FIG. 2 shows a view, with cross-section according to line 2-2 of FIG. 1, of the system in FIG. 1.

With reference to the aforementioned figures, a device for feeding metal wires which, by way of example, is that described in MI2011A001983, is represented therein. Obviously, the feeder device may be of any other known type as long as it is provided with means for controlling and actively adjusting the tension of a metal wire as described previously in the introductory part of this text. The feeder in the figures is globally denoted by reference numeral 1 and comprises a body or casing 2 having a front face 3 and lateral faces 4 and 5. The latter are closed by covering elements, one of which (that of the face 4) is not shown in FIG. 2 so as to give visual access to the inside of the body 2.

Figure 1:
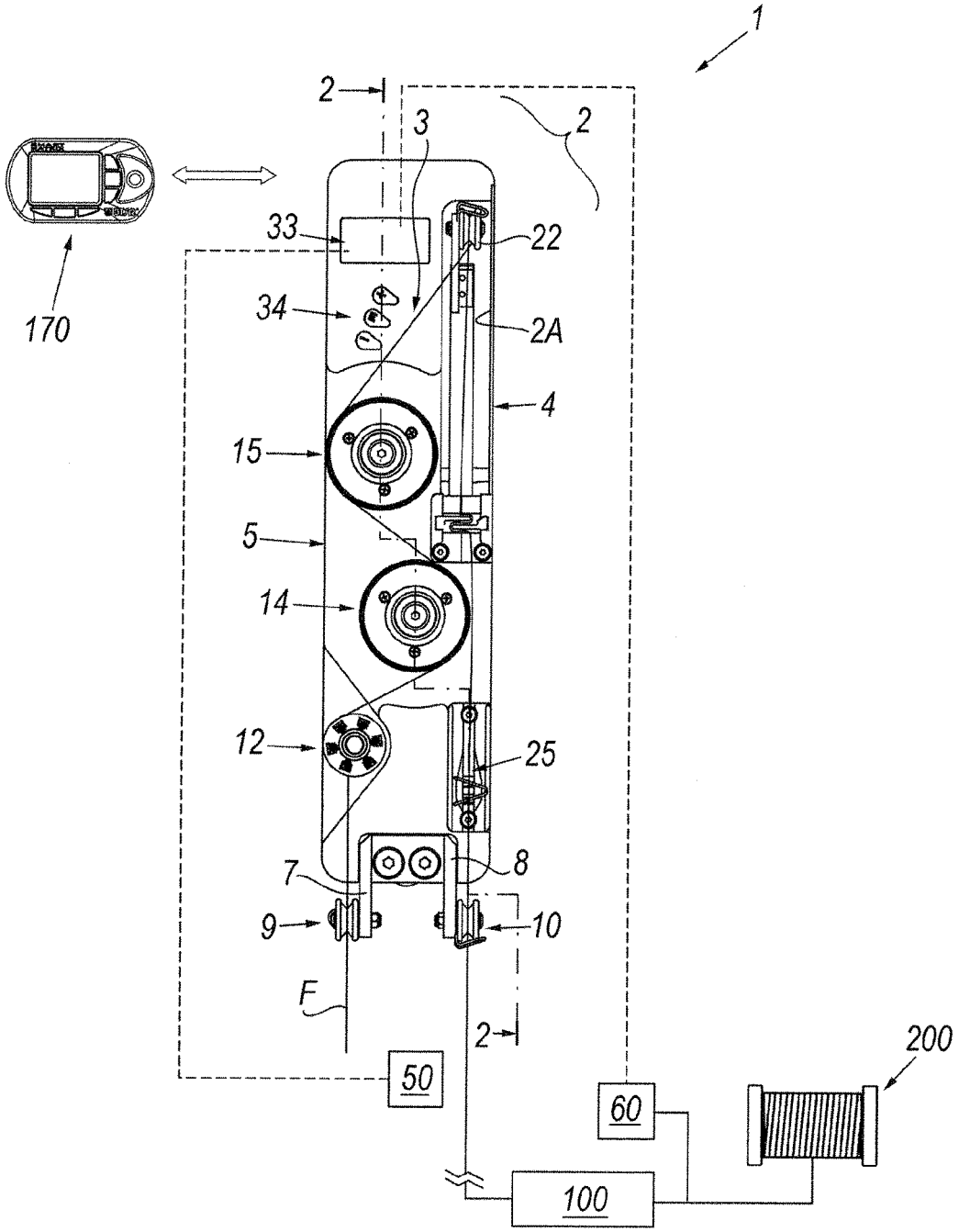
FIG. 1 shows a schematic front view of a system for feeding a metal wire according to the invention.

On the front face 3 or associated thereto and projecting therefrom (starting from the lower part of the body 2 with reference to FIG. 1) parallel members 7 and 8 are present, bearing a corresponding grooved roller 9 or 10 freely rotating on a pin fixed to the respective member. Each roller 9, 10, preferably made of ceramic, has the purpose of defining the trajectory of a metal wire F from a coil (not shown) to the device 1 and therefrom to a machine 100 which makes coils of wire F such as that indicated by reference numeral 200. The fact that the rollers are made of ceramic (or equivalent low friction coefficient material) has the purpose of minimising the friction between the wire and the roller, minimising the possibility of damaging the wire during contact.

The body 2 comprises a wire brake 12 with which the wire F co-operates at the exit of the roller 9 and which has the task of stabilising the wire in input to the device and cleaning it using the usual felts (not shown) to remove possible paraffin residues (coming from the previous operative drawing step). Such wire, coming out of the wire brake 12, meets a first pulley 14 which it is wound onto (for a fraction of rotation or for several rotations) before passing on to a second pulley 15, both said pulleys being moved by their own electric motors 16 and 17 (respectively) associated with the body 2 and controlled and commanded in the operation thereof by a control unit 18 also associated to such body.

A mobile recovery arm or compensator 20 is constrained to the latter and has, at a free end 21, a passage for the wire F, preferably through a roller 22 (also made of ceramic or the like), which such wire F reaches coming out of the pulley 15 (and passing through a window 2A of the body 2). Such mobile arm is located inside the body 2, behind the face 3 of the latter.

The wire passes from the roller 22 (or fixed, equivalent passage member) through the window 2 and then onto a tension sensor 25, for example a loading cell, also connected to the control unit 18 from which it exits to pass onto the roller 10 and be supplied to the machine.

The control unit 18 is able to measure the tension of the wire by means of the sensor 25 and adjust the rotation speed of the pulleys 14 and 15, acting on respective motors 16 and 17, and thus to control and make the tension of said wire conform to a possibly programmable pre-set value (for example depending on the various operating steps to which the wire F in the machine 100 is subjected), set in the unit 18, which may be a microprocessor and have (or co-operate with) a memory in which one or more tension data are stored in table form, for example corresponding to the aforementioned operating steps.

Such pre-set tension value may be greater or lesser than the unwinding tension of the wire from the coil.

The body 2 also bears a display 33 controlled by the unit 18 by means of which the operating conditions of the device (tension measured, pre-set tension, feed speed, etc. . . . ). are displayed. Such display also shows the operating parameters, which may be set using the keyboard 34.

The body 2 also provides for (not shown in the figures) connectors by means of which the feeder may be electrically powered, communicating with the device through a standard or proprietary field bus (RS485, CANBUS, ETHERNET . . . ) to read the state thereof (measured tension, speed, possible alarm conditions) or programme the operation thereof (operating tension, operating mode, . . . ). Such body also provides for a 0-10V dc input for programming the operating tension in analogue mode and a start-stop input for indicating to the device whether the machine is in operating mode, as well as one or more digital inputs by means of which to programme different operating tensions according to the various operating steps of the machine (wrapping, working, loading, . . . ).

At least one member 50 able to measure the diameter of the wire F and/or a member 60 able to measure the impedance value (or resistance) of a finished product comprising the wire F (for example an electrical coil) is connected to the feeder device 1 and in particular to the unit 18. In addition, a device 170 for programming such unit, for reading the data thereof or communicating therewith so as to intervene whenever desired to modify the operating mode of the feeder 1 may be connected to such unit, in wireless mode (Wi-Fi) or by means of a physical connection.

More in particular, the member 50, interfaced directly or indirectly with the unit 18, is placed at any point between the device 1 and the machine 100. This is a member for measuring the diameter of the wire F such as an electronic gauge, for example optical or laser, an electronic clearing device or similar member.

As regards the member 60 it is a resistance or impedance detector, for example an ohm detector of the coil obtained through the wire F. Such member 60, like the member 50, is directly or indirectly interfaced with the unit 18. Such connection may be made through any communication channel between the unit and said member (50 or 60), such as for example a fieldbus (RS485, CANBUS, MODBUS, PROFIBUS, . . . ) or specific inputs provided for in the two elements (Analogue Input 0-10V, Input 4-20 mA, Digital Inputs, . . . ).

During feeding to a machine, it is known that a metal wire, if subjected to too high a tension, is "stretched" and thus such tension varies the diameter thereof. As the latter varies so do the characteristics (in particular electrical, such as the electrical resistivity) of the wire itself as well as quantity of wire fed to the machine 100.

To prevent such latter drawback related to excessive tensioning of the wire F, the invention provides for the feeding thereof at a constant tension by the feed device 1 by controlling the motors 16 and 17, so as to adjust as needed the tensioning of the wire by the feeder 1 so as to achieve constancy in the feeding of the wire. Two sensors 62, 64 are associated to the motors 16 and 17 which detect the speed and/or the number of rotations or infinitesimal fraction thereof (such as Hall sensors fitted inside or outside each motor, encoders associated to the latter or other equivalent sensors in themselves known). Such members are connected to the unit 18 which, on the basis of the data received by such sensors, identifies the quantity of wire fed from the pulleys 14 and 15.

The unit 18, thus continues to feed the wire to the machine at a constant tension on the basis of a predefined set-point value, acting on said motors 16 and modifying the speed of rotation thereof (and thus changing that of the pulleys 14 and 15) if the tension value of the fed wire diverges from the set-point. The unit 18 continues to measure the quantity of fed wire (LWA) and compares such value with a predefined set-point value, operating on the set-point value of the tension, possibly adjusting it so as to achieve a constancy of the quantity of wire fed to the machine.

The predefined value of the quantity of wire fed may be a pre-set value or a self-learned value; it may in any case be modified using the keyboard 34 or by means of the device 170.

Obviously, the aforementioned control of the quantity of wire fed (or LWA), which defines a second control loop alongside the first control loop of the feeding of the wire at a constant tension, may also be performed by another control unit, obviously connected to that mentioned above 18.

The possibility of making corrections according to one or more correction ranges, for example depending on a set tension, within which the possible errors of LWA detected are compensated, is also provided for. Should the quantity of wire fed (LWA) be outside said range, an error signal and an alarm to signal to the machine 100 and/or to an operator an anomalous feed condition (bearings of the pulleys jammed, rollers 25 chipped, etc.) is generated.

The unit 18 is obviously able to memorise the tension trend and the LWA measurement of each piece produced to ensure complete traceability of the pieces produced and the quantity thereof.

Obviously, the detection of the characteristics (and namely, in the case in point, the quantity of wire fed) may be performed downstream of the feeder 1 by means of sensors (for example pulleys controlled in rotation and in the number of rotations between such feeder 1 and the machine 100) connected to the unit 18 of said feeder.

Thanks to the invention it is thus possible to feed a wire to the machine with a correct and constant tension so as to maintain it at least within a pre-set value, possibly programmable or comparable with the reference sample, the corresponding value of the quantity of fed wire LWA.

This in that the device which the present invention relates to is able to close the second adjustment loop using the information received by the sensors associated to the motors 16 and 17 or by means of detector members of the quantity of wire fed positioned downstream of the feeder 1.

For example, should a reduction of the quantity of wire be detected, the unit 18 receives the corresponding data and operates on the motors 16 and 17, according to known control algorithms P, PI, PD, PID or FOC (Field Oriented Control), accelerating or decelerating them, so as to modify the reference tension value of the wire (reducing it) so that a corresponding modification (increase) of the quantity of wire fed, up to a pre-set value may be detected. At such new tension with said quantity of wire the latter is thus fed to the machine.

The device 1 is able to guarantee the closure of this second adjustment loop and to feed the wire without varying the physical characteristics thereof (length, cross-section, resistance, . . . ). Such device, in order to guarantee the value of the desired quantity of wire fed adjusts the tension of the wire controlling the torque of the two motors 16 and 17 which move the pulleys 14 and 15 on which the wire is wound. The device is thus able to guarantee a tension (controlled by means of the sensor 25) of the wire in output greater or lesser than that present during unwinding from the coil by controlling the speed of the two motors 16 and 17 so as to be able to maintain the desired quantity of fed wire downstream of the feeder 1.

Obviously, the feeder 1 (and in particular that shown in the figures which is described in the Italian patent application MI2011A001983) is also able, by means of a control and adjustment loop thereof, to adjust the tension of the wire F in output from said feeder so as to keep it constant and equal to a possibly programmable value, but in any case such as to permit the constancy of the quantity of wire fed, such quantity conforming to a pre-set value.

One embodiment of the invention has been described; however other embodiments (such as the one in which the unit 18 or the sensor 25 are not associated to the body 2) may be made while remaining within the scope of protection of the following claims.

For example, the feeder 1 may be one of a number of different metal wire feeders associated to a machine 100 having a number of operating heads able to contemporarily produce a number of coils 200 each with at least one wire having identical physical characteristics to those of the wires of the other coils and each with the same quantity of wire as the other coils.

In such case, all the feeders 1 are connected to a single control unit (which may be: inside one of such feeders such as, for example, unit 18; the device 170; or a unit inserted in the machine 100) which verifies the tension of each wire fed by the various feeders and quantity of such wire directed to the machine 100. The aforesaid control unit compares the tension and quantity values detected by each feeder 1 with a common set-point of all the wires; in the case of discrepancy between a detected tension value or quantity and the corresponding set-point value, the control unit acts on the feeder of the specific wire for which the discrepancy was detected and in the same way as that described for the feeder 1 in FIGS. 1 and 2, acts on the motors 16 and 17 of the pulleys 14 and 15 to adjust the tension value or quantity of wire so as to make such latter value conform to the desired set-point value.

Such solution also falls within the scope of protection of the following claims.

The invention claimed is:

1. A system for feeding a metal wire unwound from a corresponding coil to a machine by means of a wire feeder, the wire being fed at a desired tension, comprising:

a tension sensor to detect the tension of the wire, the feeder having at least one rotary member driven by an actuator thereof on which the metal wire is wound, for a fraction of rotation or several rotations and suitable to supply the wire to the machine, a control unit to control the feeding of the wire at a predefined tension, said control unit, being provided to act on said rotary member to adjust the tension of the wire to maintain the tension constant at least within a pre-set and/programmable reference value, a quantity detector to detect quantity of the wire fed to the machine and connected to said control unit, said quantity detector for providing to the control unit data related to the fed quantity of wire, the control unit being suitable to detect the aforementioned quantity of wire on the basis of the data, wherein said control unit intervenes by adjusting the pre-set or programmed reference tension value to maintain the quantity of wire fed at a pre-set, self-learned and/or programmable reference value.

2. The system according to claim 1, wherein the quantity detector comprises a magnitude sensor suitable to detect a magnitude of a parameter, correlated to the rotation of the rotary member.

3. The system according to claim 2, wherein said magnitude sensor is a Hall sensor, associated to the actuator of said rotary member.

4. The system according to claim 3, wherein said magnitude sensor is an encoder associated to the actuator of said rotary member.

5. The system according to claim 2, wherein the parameter, correlated to the rotation of the rotary member is selected from the group consisting of rotary member speed, or number of rotations or infinitesimal fraction of rotation.

6. The system according to claim 1, wherein the quantity detector is associated to a rotary member placed between the feeder and the machine, said quantity detector being suitable to detect a magnitude of a parameter correlated to the rotation of said member.

7. The system according to claim 6, wherein the parameter correlated to the rotation of said member is selected from the group consisting of the member's speed of rotation or the number of rotations or infinitesimal fraction of rotation.

8. The system according to claim 1, wherein a physical characteristic detector of at least one physical characteristic of the wire is placed downstream of the feeder and connected to the control unit, and suitable to provide the control unit with the data of each physical characteristic detected, said detected physical characteristic being at least one dimensional characteristic of the wire and/or an electrical characteristic of the wire, the control unit intervening on the rotary member to adjust the tension of the wire should the detected physical characteristic differ from a pre-set and/or programmable value.

9. The system according to claim 8, wherein the physical characteristic detector is at least one from among the group consisting of:

a member for measuring the dimensional characteristic of the wire selected from the group consisting of an optical gauge, an electronic gauge, a laser gauge, and an electronic clearing device, and a member for measuring the electrical resistance/impedance of the wire selected from the group consisting of an ohm detector, said member for measuring the dimensional characteristic being placed between the supply device and the machine, said member for measuring the electrical resistance of the wire being alternately placed at the machine or being suitable to measure such physical characteristic of the wire when said member for measuring the electrical resistance is associated to a finished product.

10. The system according to claim 9, wherein the dimensional characteristic is wire diameter.

11. The system according to claim 8, wherein the dimensional characteristic is wire diameter.

12. The system according to claim 1, wherein the control unit is a microprocessor and is suitable to adjust the torque generated by the actuator on the rotary member depending on the quantity of wire fed detected by said quantity detector, said tension possibly being greater or lesser than that of unwinding the wire from the corresponding coil.

13. The system according to claim 1, comprising at least one of the following characteristics:

the control unit and a physical characteristic detector of the physical characteristic of the wire are associated to the machine;

the physical characteristic detector of the physical characteristic of the wire are associated to the machine;

the physical characteristic detector of the physical characteristic of the wire are directly attached to the feeder;

said control unit and said tension sensor are associated to the feeder;

the feeder is an electromechanical feeder;

the feeder is an electronic feeder.

14. The system according to claim 1, comprising a plurality of feeders suitable to feed a plurality of metal wires to the machine, the machine comprising a plurality of operating heads each operating on a row of said plurality of wires, the control unit connected to said feeders, the control unit being suitable to receive the data supplied to the machine by each feeder and to compare the data with a self-learned and/or programmable pre-set value, said control unit intervening on the rotary member of each feeder should the data received be different from the pre-set and/or programmable value to conform the feeder to the pre-set and/or programmable value.

15. The system according to claim 1, wherein the machine is a winding machine comprising at least one operating head for producing coils.

16. A method of feeding a metal wire unwound from a coil to a machine, said feeding taking place by means of the system according to claim 1, said method comprising the steps of picking up the wire from the coil, supplying the wire to a feeder of the wire suitable to send the wire to the machine at a desired tension detected by a tension sensor, the tension sensor connected to a control unit which controls and commands said feeding of the wire at constant tension, at least one rotary member suitable to co-operate with the wire associated to said feeder being provided, wherein a quantity detector detects quantity of the wire fed, the quantity detector connected to the control unit and suitable to provide to the control unit the data detected, the control unit commanding and controlling the feeding of the wire by intervention on said rotary member when such data differs from a pre-set and/or programmable reference value, wherein the control unit adjusts the pre-set or programmed reference tension value to maintain the quantity of wire fed at a pre-set, self-learned and/or programmable reference value.

* * * * *